US005934529A

United States Patent [19]

O'Brien

[11] Patent Number: 5,934,529

[45] Date of Patent: Aug. 10, 1999

[54] BABY BACKPACK SUN/RAIN SHADE DEVICE

[76] Inventor: Vincent E. O'Brien, 241 Via Barranca, Greenbrae, Calif. 94904

[21] Appl. No.: 08/948,894

[22] Filed: Oct. 10, 1997

Related U.S. Application Data

[63] Continuation-in-part of application No. 08/695,710, Jul. 19, 1996, Pat. No. 5,695,100.

[51] Int. Cl.[6] ..... A47C 7/66; E04H 15/02

[52] U.S. Cl. ..... 224/160; 224/186; 135/96

[58] Field of Search ..... 224/154, 156, 224/186–190, 158–161; 135/90, 95, 96, 125, 126, 119

[56] References Cited

U.S. PATENT DOCUMENTS

| | | | |
|---|---|---|---|
| 620,008 | 2/1899 | Woodward | 135/90 |
| 725,348 | 4/1903 | Mann | 135/90 |
| 862,779 | 8/1907 | Williams et al. | 135/90 |
| 2,190,566 | 2/1940 | Julian | 135/95 |
| 3,840,161 | 10/1974 | Boggs et al. | 224/161 |
| 4,112,957 | 9/1978 | Biven | 135/5 |
| 4,286,739 | 9/1981 | Silcott et al. | 224/156 |
| 4,293,162 | 10/1981 | Pap et al. | 297/184 |
| 4,809,724 | 3/1989 | Fuser | 135/16 |
| 4,883,315 | 11/1989 | Ferguson | 297/184 |
| 4,915,120 | 4/1990 | Ziolkowski | 135/90 |
| 5,007,674 | 4/1991 | Franc | 297/184 |
| 5,080,119 | 1/1992 | Scherer | 135/127 |
| 5,135,281 | 8/1992 | Pappalardo | 135/90 |
| 5,205,308 | 4/1993 | Kendall et al. | 135/90 |
| 5,320,405 | 6/1994 | Foster et al. | 297/184.17 |
| 5,363,871 | 11/1994 | Garrand et al. | 135/90 |
| 5,609,279 | 3/1997 | O'Shea | 224/158 |

*Primary Examiner*—Charles R. Eloshway
*Attorney, Agent, or Firm*—Beyer & Weaver, LLP

[57] ABSTRACT

A sunshade device for use with a baby backpack formed for supporting a baby occupant therein includes a substantially flexible, resilient rod having an upper bight portion and a pair of spaced-apart leg portions. The first leg portion is coupled to the baby backpack proximate one side of the seat support, and an opposite second leg portion of the rod is coupled to the baby backpack proximate an opposite second side of the seat support. The bight portion and the leg portions cooperate to bias the resilient rod toward an uncovered position which does not shield the seated occupant. The sunshade device further includes a flexible, sheet-like sunshade coupled to the resilient rod which spans the bight portion and the leg portions. A retaining device is provided which is adapted to couple the bight portion to a forward portion of the backpack in a manner tautly retaining the resilient bight portion and the sheet-like sunshade in a covered position. In this position, the sunshade portion extends over the seated occupant for shielding thereof.

7 Claims, 11 Drawing Sheets

BABY BACKPACK SUN/RAIN SHADE DEVICE

RELATED APPLICATION

This application is a continuation-in-part application based upon patent application Ser. No. 08/695,710, filed Jul. 19, 1996, now U.S. Pat. No. 5,695,100, and entitled BABY BACKPACK SUN/RAIN SHADE DEVICE.

TECHNICAL FIELD

The present invention relates, generally, to sun shade devices, and, more particularly, relates to sun/rain shades mountable to baby backpacks.

BACKGROUND ART

Recently, baby backpacks have experienced a substantial growth in popularity as a desirable alternative to strollers or physically holding the baby. These backpacks enable a convenient and comfortable means of carrying or supporting a child during extended excursions such as nature hikes or the like.

Typically, a lightweight foldable tubular frame is provided which is mountable and supportable on the backpacker's back, shoulders and waist. These frames usually include an upper horizontal cross-bar and opposing, spaced-apart side frame portions extending generally vertically downward from the cross-bar and on opposite sides of the baby occupant. A flexible sheet-like support is generally suspended or mounted to the frame member which is formed to secure and support the child therein.

While these baby backpacks adequately provide reasonable comfort for the child and backpacker during outdoor hikes, the child's upper extremities may be left completely exposed to the sun, rain and other environmental elements. Such overexposure to the sun may cause a substantial sunburn on the child's delicate skin and features. Not only is this extremely discomforting, but repeated burning may increase susceptibility to future skin problems. Moreover, overexposure to the sun can cause heat prostration as well; while extended exposure to the rain can cause numerous sicknesses

DISCLOSURE OF INVENTION

Accordingly, it is an object of the present invention to provide a baby backpack device which protects the child from the sun and rain.

It is another object of the present invention to provide a baby backpack sunshade device which can be retrofitted to most baby backpacks.

Another object of the present invention is to provide a baby backpack sunshade device which is lightweight.

Still another object of the present invention is to provide a baby backpack sunshade device which is easily detachable from the backpack frame.

Yet another object of the present invention is to provide a baby backpack sunshade device which can be moved between a covered and uncovered condition.

It is still another object of the present invention to provide a baby backpack sunshade device which easily enables ingress and egress from the baby chair.

Another object of the present invention to provide a baby backpack sunshade device which can easily be folded against the backpack frame for storage purposes.

It is a further object of the present invention to provide a baby backpack sunshade device which is durable, compact, easy to maintain, has a minimum number of components, and is easy to use by relatively unskilled personnel.

In accordance with the foregoing objects, the present invention provides a sunshade device for use with a baby backpack formed for supporting a baby occupant therein, and including a first frame portion and an opposing second frame portion. The sunshade device includes a first mounting bracket coupled to the first frame portion, and a second mounting bracket coupled to the second frame portion. A U-shaped rear shade support includes a rear bight portion extending upwardly from the backpack. One end of the rear shade support is coupled to the first mounting bracket and an opposite end is coupled to the second mounting bracket. The baby backpack shade device of the present invention further includes a U-shaped front shade support having a front bight portion extending upwardly from the backpack, and having a first end and an opposite second end pivotally coupled to the first mounting bracket and the second mounting bracket, respectively. In accordance with the present invention, the front shade support is movable between a closed position, nested with the rear shade support, and an opened position, extending forwardly of the rear shade support. A flexible, sheet-like sunshade is also included having a rear end mounted to the rear bight portion of the rear shade support and an opposite front end mounted to the front bight portion of the front shade support. Hence, in the opened position, the sheet-like sunshade is oriented to extend vertically over the occupant for shielding thereof. Further, in the closed position, the sunshade is selectively closed rearwardly of the occupant to enable easy ingress and egress from the backpack.

The first mounting bracket and the second mounting bracket each preferably includes a mounting wall defining a V-shaped mounting groove formed and dimensioned to receive the first frame portion and the second frame portion, respectively, therein. Moreover, each bracket includes a securing device for removably mounting the respective frame portion in the mounting groove of the mounting bracket.

In another aspect of the present invention, the sunshade device includes a substantially flexible, resilient rod having an upper bight portion and a pair of spaced-apart leg portions. The bight portion is adapted for extending upwardly from the backpack, and the leg portions are adapted for extending downwardly from opposite sides of the bight portion. The first leg portion is coupled to the baby backpack proximate one side of the seat support, and an opposite second leg portion of the rod is coupled to the baby backpack proximate an opposite second side of the seat support. The bight portion and the leg portions cooperate to bias the resilient rod toward an uncovered position which does not shield the seated occupant. The sunshade device further includes a flexible, sheet-like sunshade coupled to the resilient rod which spans the bight portion and the leg portions. A retaining device is provided which is adapted to couple the bight portion to a forward portion of the backpack in a manner tautly retaining the resilient bight portion and the sheet-like sunshade in a covered position. In this position, the sunshade portion extends over the seated occupant for shielding thereof.

The retaining device preferably includes two spaced-apart strap members each having one end coupled to a respective upper portion of the bight portion and an opposite end coupled to respective forward portions of the backpack. Each strap is preferably selectively releasable and adjustable in length.

In the covered position, the flexible, resilient rod is configured to generate a first moment about the first leg and second leg portions to bias the resilient rod back toward the uncovered condition. The first moment is generated about a first axis extending through both the first leg portion and the second leg portion. The flexible, resilient rod is further configured to generate a second moment about a second axis oriented substantially perpendicular to the first axis to bias the bight portion in a taut opened position.

The sunshade device further provides a first mounting bracket for releasably coupling the first leg portion to a first frame portion of the baby backpack, and a second mounting bracket for releasably coupling the second leg portion to an opposite second frame portion of the baby backpack. The first mounting bracket and the second mounting bracket are mounted to a stabilizing bar extending transversely from the first frame portion to the second frame portion.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
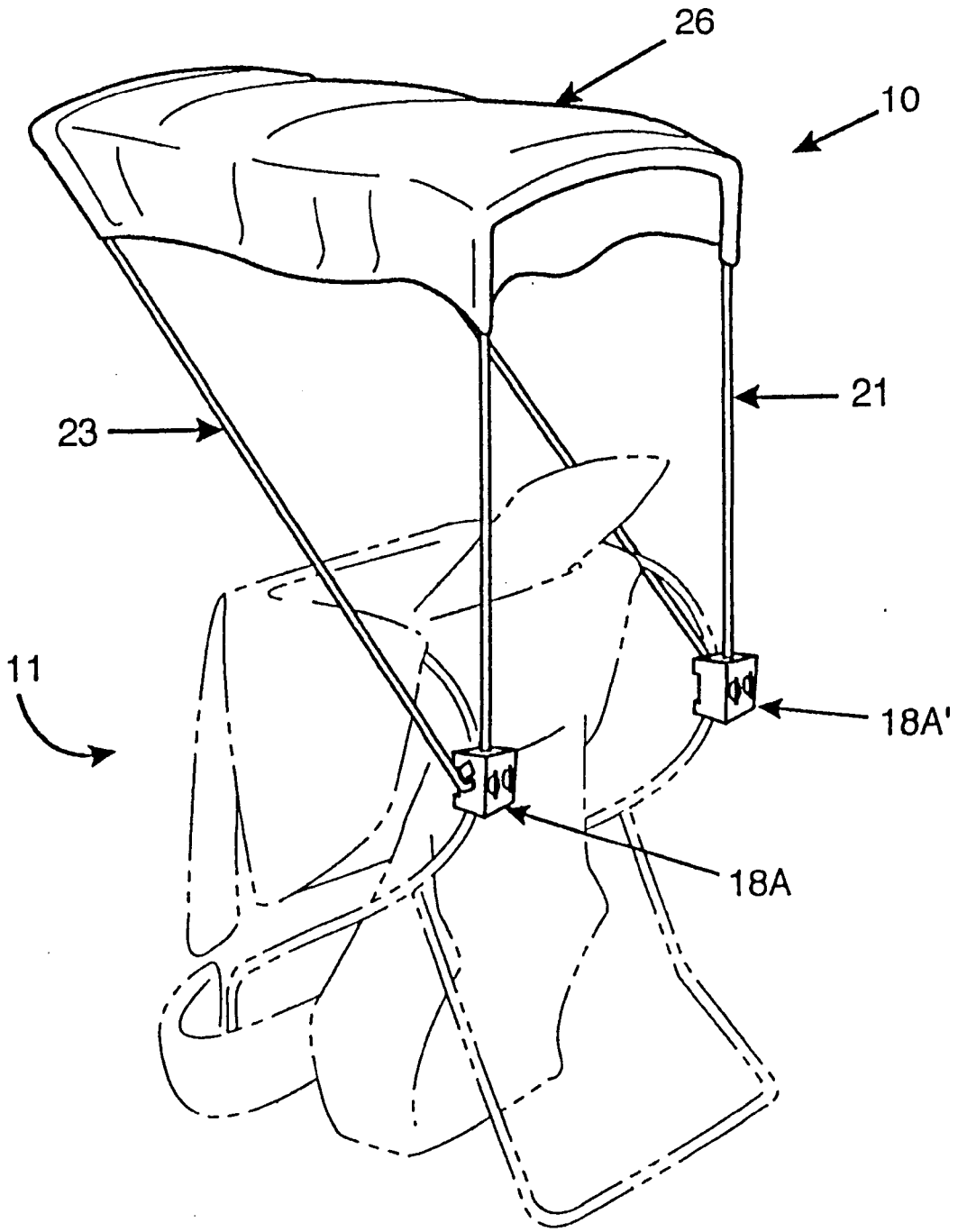
FIG. 1 is a top perspective view of a baby backpack sunshade device constructed in accordance with the present invention, shown mounted to a baby backpack apparatus.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 3:
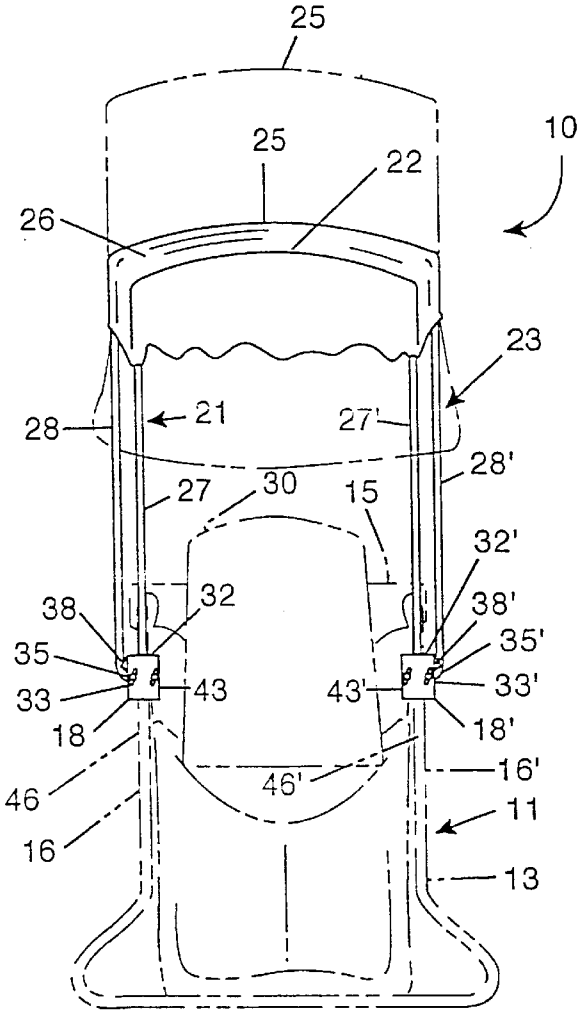
FIG. 3 is a rear elevation view of the baby backpack sunshade device of FIG. 1.
Figure 2:
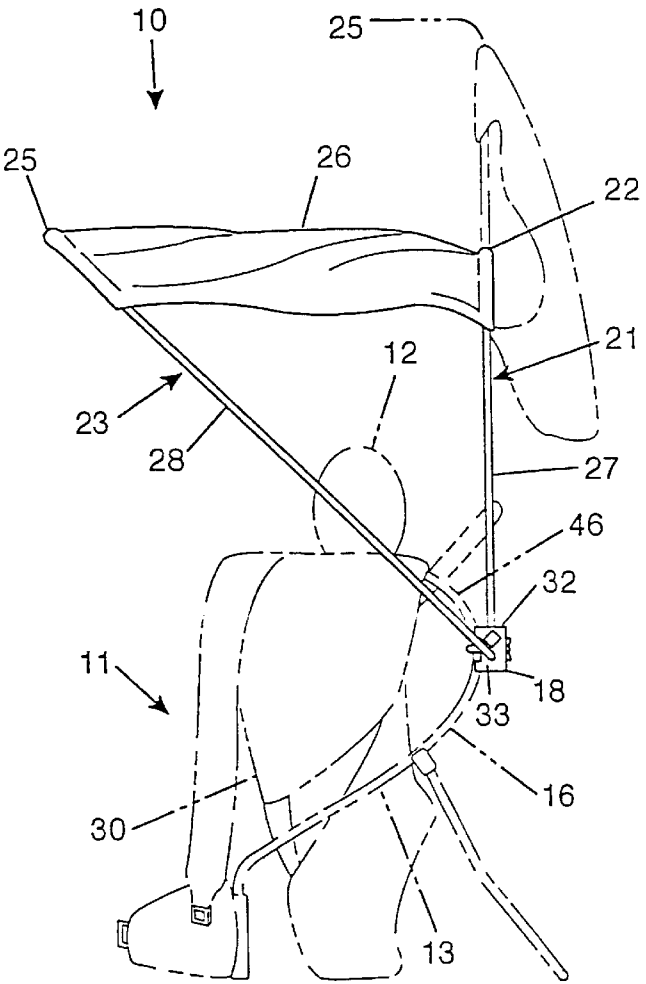
FIG. 2 is a side elevation view of the baby backpack sunshade device of FIG. 1, illustrating movement thereof between an opened position (shown in solid lines) and a closed position (shown in broken lines).

Attention is now directed to FIGS. 1–3, where the present invention provides a sunshade device, generally designated 10, for use with a baby backpack 11 formed for supporting a baby occupant 12 therein. Briefly, the baby backpack includes a backpack frame 13 having a crossbar 15 rigidly securing a first frame portion 16 and an opposing second frame portion 16'. The sunshade device 10 of the present invention includes a first mounting bracket 18 coupled to first frame portion 16, and a second mounting bracket 18' coupled to second frame portion 16'. For ease of description, only one mounting bracket 18 (FIG. 5) will be referred to since the opposite mounting bracket 18' (and its associated structure) is a mirror image of mounting bracket 18. A U-shaped rear shade support, generally designated 21, includes a rear bight portion 22 extending upwardly from baby backpack 11. One end of rear shade support 21 is coupled to first mounting bracket 18 while an opposite end thereof is coupled to second mounting bracket 18'. The baby backpack shade device 10 of the present invention further includes a U-shaped front shade support, generally designated 23, having a front bight portion 25 extending upwardly from backpack 11 and having a one end and an opposite end pivotally coupled to the first mounting bracket 18 and the second mounting bracket 18', respectively.

In accordance with the present invention, front shade support 23 is movable between a closed position (phantom lines in FIG. 2), nested with rear shade support 21, and an opened position (solid lines in FIG. 2), extending forwardly of rear shade support 21. A flexible, sheet-like sunshade 26 is also included having a rear end mounted to rear bight portion 22 of the rear shade support 21 and an opposite front end mounted to front bight portion 25 of front shade support 23. In the opened position, the sheet-like sunshade 26 is oriented to extend vertically over the occupant 12 for shielding thereof. Further, in the closed position, sunshade 26 is closed rearwardly of the occupant 12 to enable easy ingress and egress from backpack 11.

Accordingly, a sunshade device is provided for baby backpacks for protective shading to the baby occupant from the sun or rain. This sunshade device is formed and dimensioned to be retrofit to a plurality of baby backpacks, such as the GERRY® backpack, the TOUGH TRAVELER® backpack, the KELITY® backpack, and any other baby backpack with an exposed rear frame. The present invention sunshade device is capable of articulation between a closed position, facilitating ingress and egress from the baby seat, and an opened position, providing protective cover vertically over the child's head and shoulders from the damaging rays of the sun.

As best shown in FIGS. 2 and 3, each rear and front shade support is generally U-shaped having bight portions 22, 25 and two downwardly depending leg portions 27, 27' and 28, 28', respectively. It will be appreciated that the term "U-shaped" includes any shaped support having a cross-bar and two downwardly depending leg portions therefrom. Hence, the bight portion could be arcuate, smoothly integrated with the leg portions, or substantially straight, intersecting the leg portions perpendicularly or at generally right angles.

Rear shade support 21 is preferably mounted to the spaced-apart bracket members 18, 18', to be described in greater detail below, in a manner positioning the rear bight portion 22 rearwardly of the baby occupant 12. Accordingly, when the front shade support 23 is positioned in the closed position (phantom lines in FIG. 2), nested with the rear shade support 21, the sheet-like sunshade 26 is preferably positioned behind the seated baby. This provides ample room for ingress and egress to and from the baby seat support 30 which is suspended or mounted to the backpack frame 13. Further, such rearward positioning of the rear shade support 21 relative the backpack frame 13 assures that the sheet-like sunshade 26 extends sufficiently rearwardly of the seated baby occupant 12 to provide ample shading or sun shielding rearwardly thereof.

As viewed in the solid lines of FIG. 2, the front shade support 23 is formed and dimensioned to articulate the front bight portion 25 thereof to an orientation forward of the seated baby occupant 12 when the front shade support is in the opened position. Similar to the rearward positioning of the rear shade support 21, the forward positioning of the front bight portion 25 relative the backpack frame 13 assures that the sheet-like sunshade 26 extends sufficiently forward of the seated baby occupant to provide ample coverage or sun shielding forwardly thereof. Accordingly, in the opened position, the rear shade support 21, the front shade support 23 and the sheet-like sunshade 26 cooperate to provide substantial sun shielding during outdoor use.

In the preferred embodiment, the leg portions 27, 27' of rear shade support 21 are releasably and slidably mounted in respective mounting bore 31, 31' formed in the top surfaces 32, 32' of the first and second mounting brackets 18, 18'. Hence, the rear shade support can be easily removed from the mounting brackets to facilitate storage or transportability. Further, it will be understood that while the leg portions 27, 27' of rear shade support 21 are oriented substantially vertical and parallel one another, the leg portions may be angled relative one another and relative the mounting brackets without departing from the true spirit and nature of the present invention.

Figure 5:
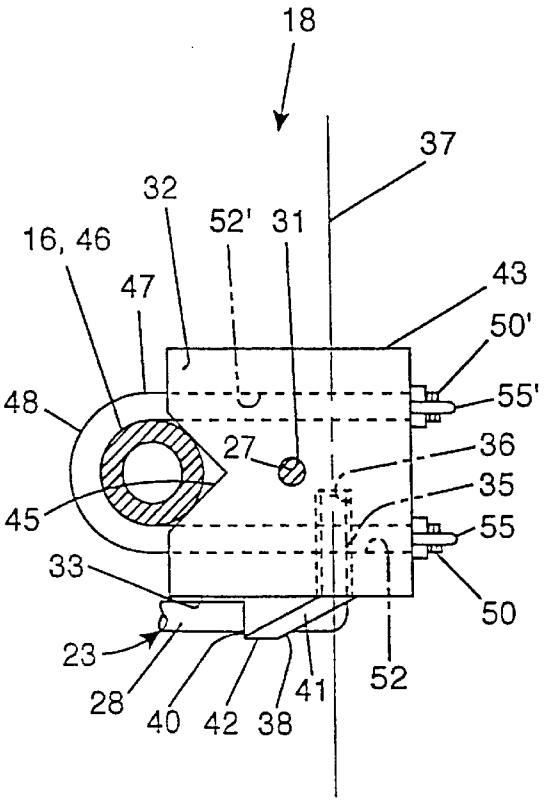
FIG. 5 is a fragmentary, top plan view of the mounting bracket of FIG. 4.

Regarding the front shade support 23, to facilitate articulate motion between the closed position and the opened position, the distal ends of the leg portions 28, 28' are pivotally coupled to the respective mounting brackets 18, 18'. Again, for ease of description, only mounting bracket 18 (FIG. 5) will be referred to since the opposite mounting bracket 18' (and its associated structure) is a mirror image of mounting bracket 18. FIG. 5 illustrates that each leg portion 28, 28' of the front shade support includes a finger portion 35, 35' angled inwardly toward the respective outer side wall 33, 33' for pivotal engagement therewith. Accordingly, in the closed position, the leg portions 28, 28' of the front shade support 23 are nested outside and adjacent the respective leg portions 27, 27' of the rear shade support (FIG. 3), so as not to interfere with one another during the pivotal movement. Each outer side wall of mounting bracket 18, 18' includes finger passageways 36, 36' formed and dimensioned for sliding and rotational receipt of the respective finger portions 35, 35' therein.

As best viewed in FIG. 5, each finger portion 35, 35' is capable of rotational movement therein about a rotational axis 37 extending longitudinally through each finger portion. This arrangement enables pivotal movement of the front shade support between the closed and opened position. In the preferred form, when the front shade support is moved to the closed position, the outer leg portions thereof are situated in substantially the same plane extending through the leg portions 27, 27' of the rear shade support 21.

A wedge-shaped stop member 38, 38' extends outwardly from each outer side wall 33, 33' which is formed to retain the leg portions 28, 28' in the opened position. Each stop member includes shoulder portion 40 formed to engage the respective leg portion to prevent inadvertent collapse of movement to the closed position which is extremely desirable during windy conditions.

FIG. 5 illustrates that the backside of each stop member 38, 38' includes a gradually sloped face 41 formed to enable easy deployment to the opened position from the closed position. Accordingly, when the front shade support 23 is moved from the closed position to the opened position, the leg portions 28, 28' of the front shade support 23 slidably contact the sloped face 41 until the leg portions move just past the intersecting edge 42 between shoulder portion 40 and the sloped face 41. Once past, the respective finger portions 35, 35', which have moved outwardly of the respective finger passageway 36, 36' in a direction away from the respective outer side wall 33, 33', move inwardly toward the respective outer side wall and into the finger passageway to lock in the opened position and into contact against the shoulder portions thereof.

Movement back to the closed position is easily accomplished by pulling the finger portions out of the respective finger passageway until the respective leg portions clear the shoulder portion. Subsequently, the front shade support 23 can be articulated back into a nested position with the rear shade support 21.

While the preferred embodiment is illustrated with the leg portions of the front shade support arranged on the outside of the leg portions of the rear shade support, it will be appreciated that the leg portions 28, 28' of the front shade support could be pivotally coupled to the respective inner side walls 43, 43' of the respective mounting brackets without departing from the true nature and spirit of the present invention.

Figure 4:
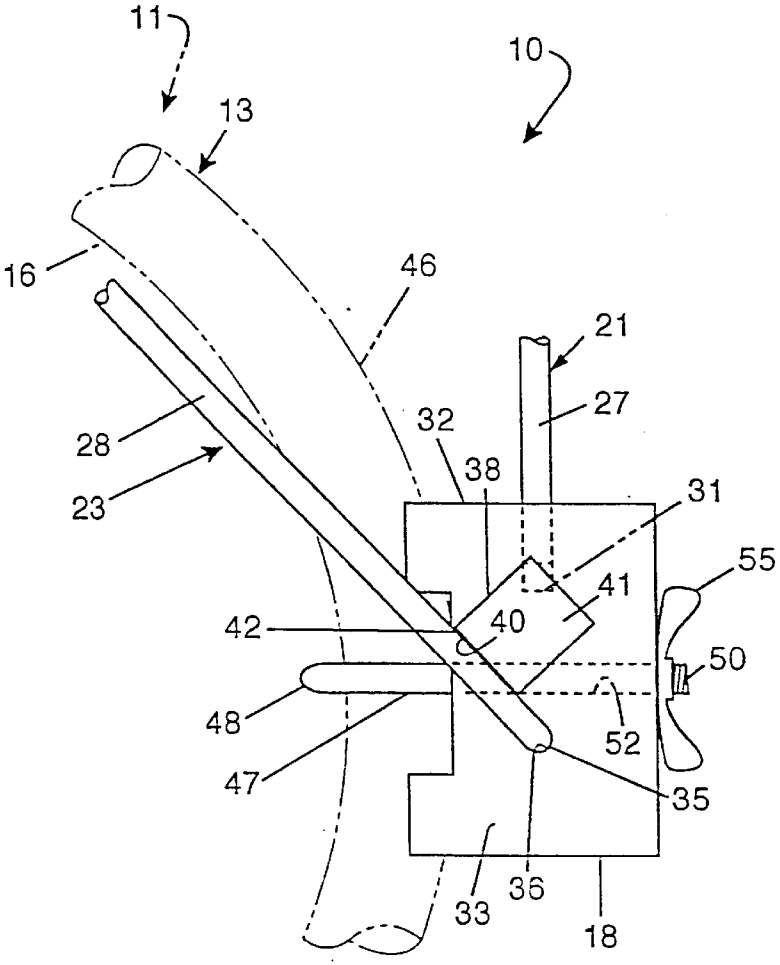
FIG. 4 is an enlarged, fragmentary, side elevation view of a mounting bracket of the baby backpack sunshade device of FIG. 1.

Turning now to FIGS. 4 and 5, each mounting bracket 18, 18" is formed and dimensioned for releasable mounting to the tubular first and second frame portions 16, 16' of the backpack frame 13. Again, for the ease of description, however, only one mounting bracket 18 will be described in detail since the opposing mounting bracket 18' is merely the mirror image thereof. Mounting bracket 18 includes a mounting groove 45 shaped to receive a portion of the respective frame portion 16 therein. Preferably, the mounting groove 45 is V-shaped to accommodate frame portions 16, 16' of varying shapes and diameters. Moreover, as shown in FIG. 4, mounting groove 45 is formed to secure against both straight frame portions or curved frame portions. This is advantageous for retrofitting since many baby backpack frames 13 include U-shaped curved portions 46, 46' (shown in phantom) which extend rearwardly of the cross-bar 15.

To secure the respective frame portion in the V-shaped groove 45 a securing device 47 in the form of a U-shaped bolt 47 is provided to releasably mount the respective mounting bracket to the first and second frame portions, respectively. As best viewed in FIG. 5, each U-shaped bolt includes a bolt bight portion 48 formed and dimensioned to extend around the tubular frame portion for secured engagement therewith. The leg portions 50, 50' of bolt 47 are formed for sliding receipt through longitudinal holes 52, 52' extending through the mounting bracket 18 from the front side to the back side. Wing nuts 55, 55' or the like urge the bight portion into contact with the frame portion 16 which in turn urge the frame portion 16 into contact with the V-shaped groove 45.

It will be understood that a variety of other type securing devices may be provided which are generally known to those skilled in the art without departing from the true nature and spirit of the present invention. These may include, although are not limited to, hook-shaped bolts, pivotal jaws or other clamping devices.

Figure 6:
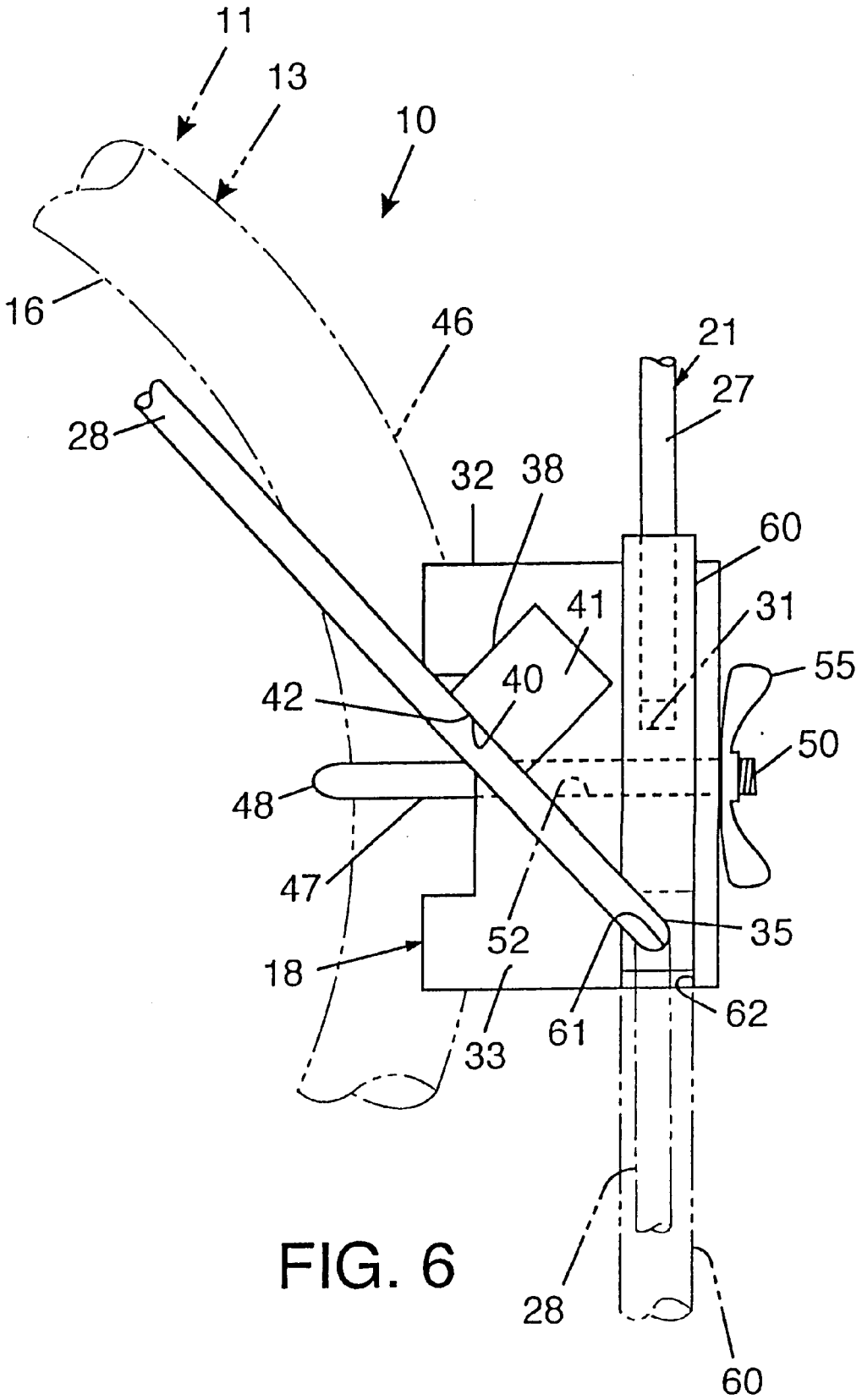
FIG. 6 is an enlarged, fragmentary, side elevation view of an alternative embodiment of a mounting bracket for the baby backpack sunshade device of FIG. 1.
Figure 8:
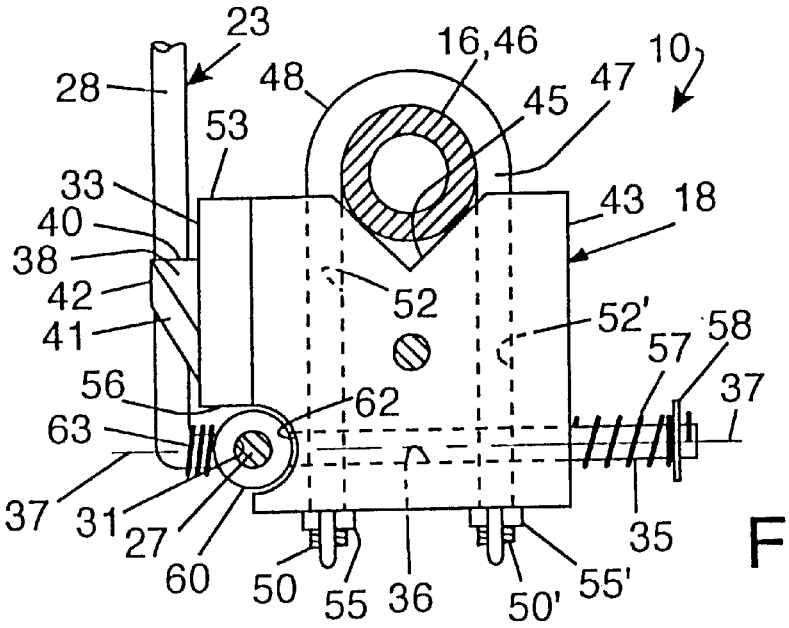
FIG. 8 is a fragmentary, top plan view of the mounting bracket of FIG. 6.
Figure 7:
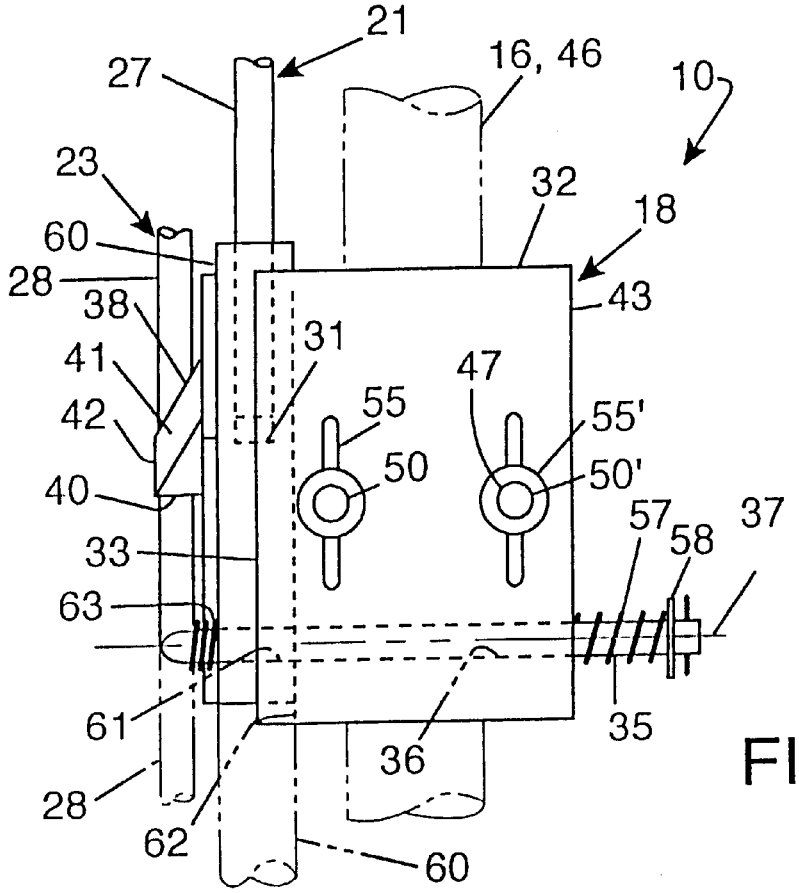
FIG. 7 is a fragmentary rear elevation view of the mounting bracket of FIG. 6.

Turning now to FIGS. 6–8, an alternative embodiment to the present invention will be described in which the leg portions 28, 28' of front shade support 23 are biased in a direction inwardly in a manner urging the respective finger portions 35, 35' into the finger passageways 36, 36'. Again, for the ease of description, only one mounting bracket 18 will be described in detail since the opposing mounting bracket 18' is merely the mirror image thereof. As shown, a first spring member 57 is included urging leg portion 28 inwardly toward respective mounting bracket 18. This is particularly advantageous to retain front shade support 23 in the opened position and in contact with shoulder portion 40 of stop member 38.

In the preferred embodiment, as best viewed in FIG. 7, finger portion 35 is formed and dimensioned to fit through finger passageway 36 such that a distal end thereof extends beyond inner side wall 43. First spring member first 57 is preferably provided by a compression spring which is compressed between inner side wall 43 and a washer member 58 or the like mounted proximate the distal end of finger portion 35. Accordingly, the outward axial force caused by first compression spring 57 urges finger portion 35 to extend further into finger passageway 36 until the leg portion 28 of front shade support 23 nearly abuts against the base member 60 proximate the outer side wall 33. This assures that the leg portion will be locked behind and against the shoulder portion 40 of stop member 38 when oriented in the opened position.

In yet another alternative embodiment of the present invention, after front shade support 23 has been moved to the closed position (solid lines in FIGS. 6 and 7). nested with rear shade support 21, both shade supports may be pivoted rearwardly as a unit to a further stowed position (phantom lines in FIGS. 6 and 7), positioning the shade supports 21, 23 and sheet-like sunshade 26 out of the way for ease of storage. Hence, disassembly of the front and rear shade supports from the respective mounting brackets for storage purposes will be precluded in many instances.

As shown in FIGS. 6 and 8, a pivotal base member 60, preferably tubular, is provided pivotally coupled to the outer side wall 33 of mounting bracket 18. A top surface of base member 60 defines mounting bore 31 therein which is formed to receive the distal end to the leg portion 27 of rear shade support 21. To enable the base member 60 and the rear shade leg portion 27 to pivot as a unit, the finger portion 35 of the front shade leg portion 28 extends through a hole 61 proximate a lower end of base member 60. Hence, finger portion 35 extends through both base member 60 and mounting bracket 18 so that the shade supports pivot relative one another and relative the bracket member between the closed position and the stowed position.

To facilitate maintenance of the base member in either the closed position or the stowed position, outer side wall 33 provides a retaining slot 62 (FIG. 8) extending substantially vertically therealong. Retaining slot 62 is preferably semi-cylindrical shaped and of a diameter similar to that of tubular base member 60. Accordingly, when base member 60 is generally aligned with retaining slot 62 in preferably a substantially vertical closed position or the stowed position, the base member is received in the retaining slot for support therein.

To articulate the front and rear shade supports between the closed and stowed position, base member 60 must be removed from retaining slot 62 in a direction outwardly along axis 37. This is accomplished by moving both the leg portions of respective front and rear shade supports outwardly along axis 37 until base member 60 is removed from retaining slot 62 by a distance sufficient to clear stop member 38. Base member 60 can then be pivoted about axis 37.

Once pivotally moved to the desired orientation (i.e., the closed position or the stowed position), the compressed first spring member 57 will urge finger portion 35 back into finger passageway 36, and base member 60 back into retaining slot 62. FIG. 8 further illustrates the addition of a second spring member 63 provided between leg portion 28 and base member 60 to further urge the base member into retaining slot 62. Second spring member 63 further enables movement of leg portion 28 of the front shade support without disturbing the positioning of base member 60 and the rear shade support. It will be appreciated, however, that the compressive force of the first spring member 57 is greater than the compressive force of second spring member 63.

To further prevent base member 60 from pivoting forwardly toward the skewed leg portions 28, 28' of front shade support 23 in the opened position, a forward stop portion 53 of outer side wall 33 protrudes further outward (FIG. 8) deepening the retaining slot 62 in the forward direction. Hence, inadvertent forward pivotal movement of base member 60 is substantially more difficult as the base member will contact a retaining wall 56 of forward stop portion 53.

In an effort to provide further protection to the child occupant during operation, the sheet-like sunshade 26 could include a mosquito netting or the like (not shown) which drapes around and the perimeter of the sheet-like shade. This arrangement will assure ample circulation while providing additional protection against insects. Moreover, the sheet-like sunshade could include front, side and/or rear curtains or shielding to further extend down the sides of the front and rear shade supports for added protection from the sun.

Figure 9B:
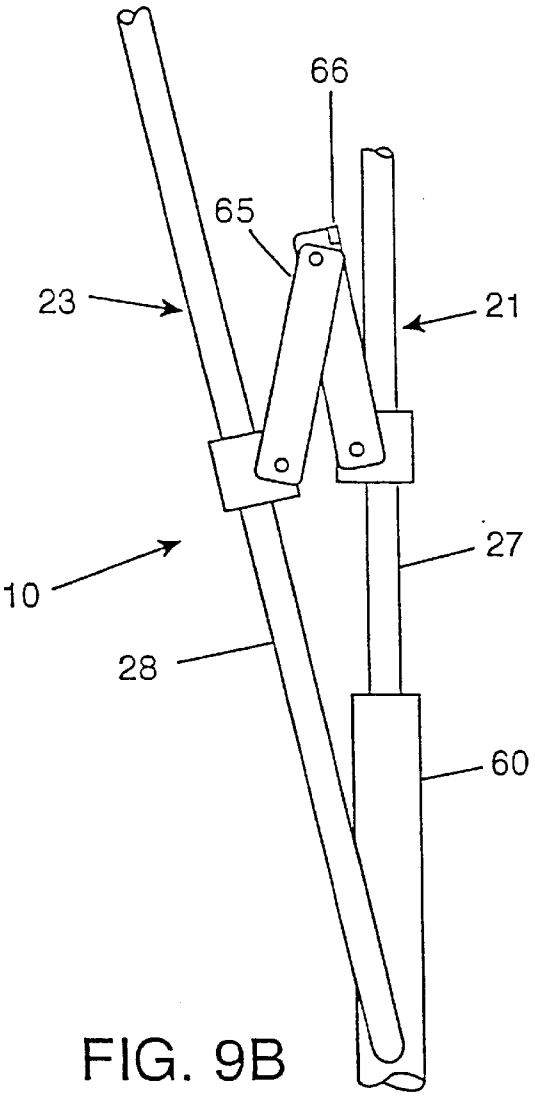
FIGS. 9A and 9B are side elevation views of an alternative embodiment of the backpack sunshade device incorporating a scissors-type joint between the shade supports.
Figure 9A:
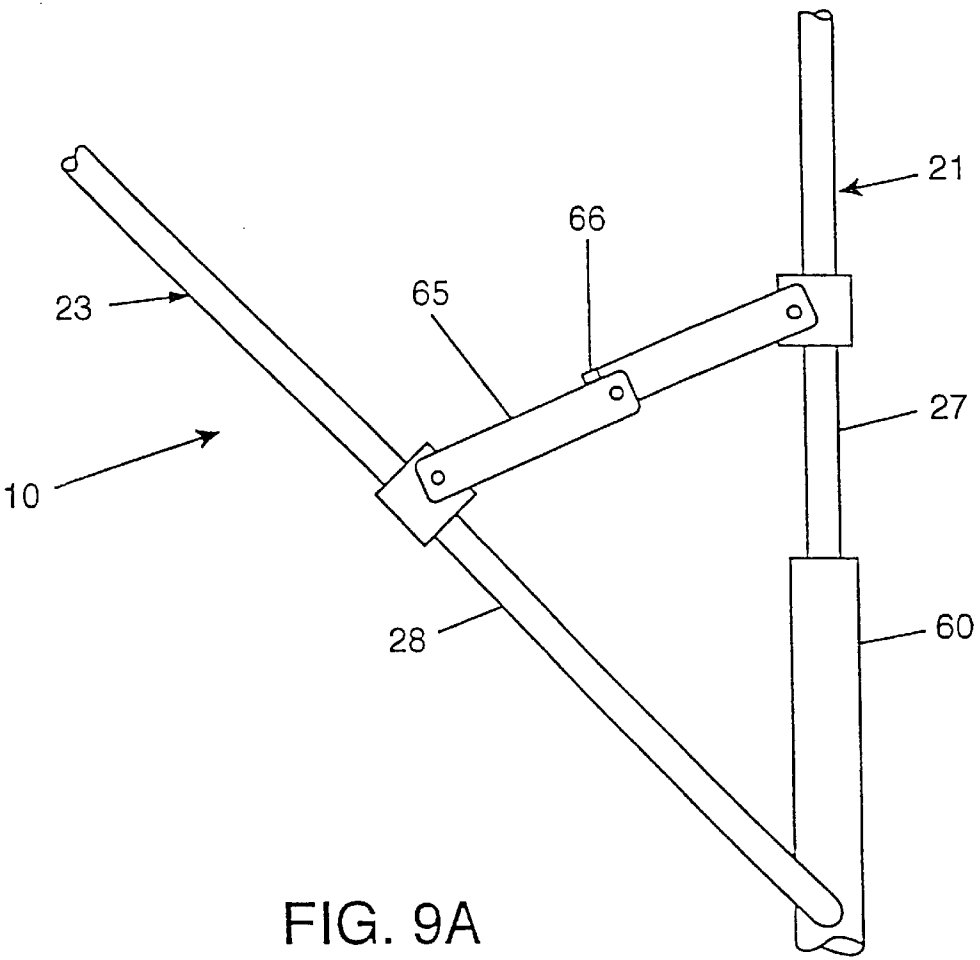
Figure 11:
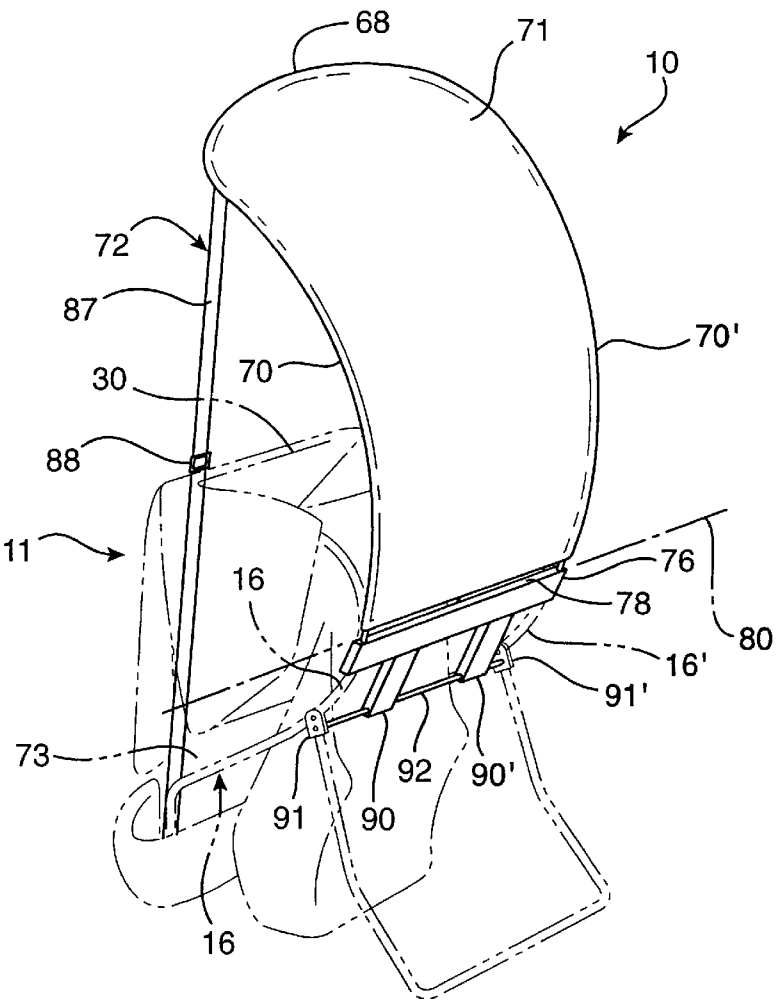
FIG. 11 is a rear perspective view of the baby backpack sunshade device of FIG. 10 shown in a covered position.
Figure 10:
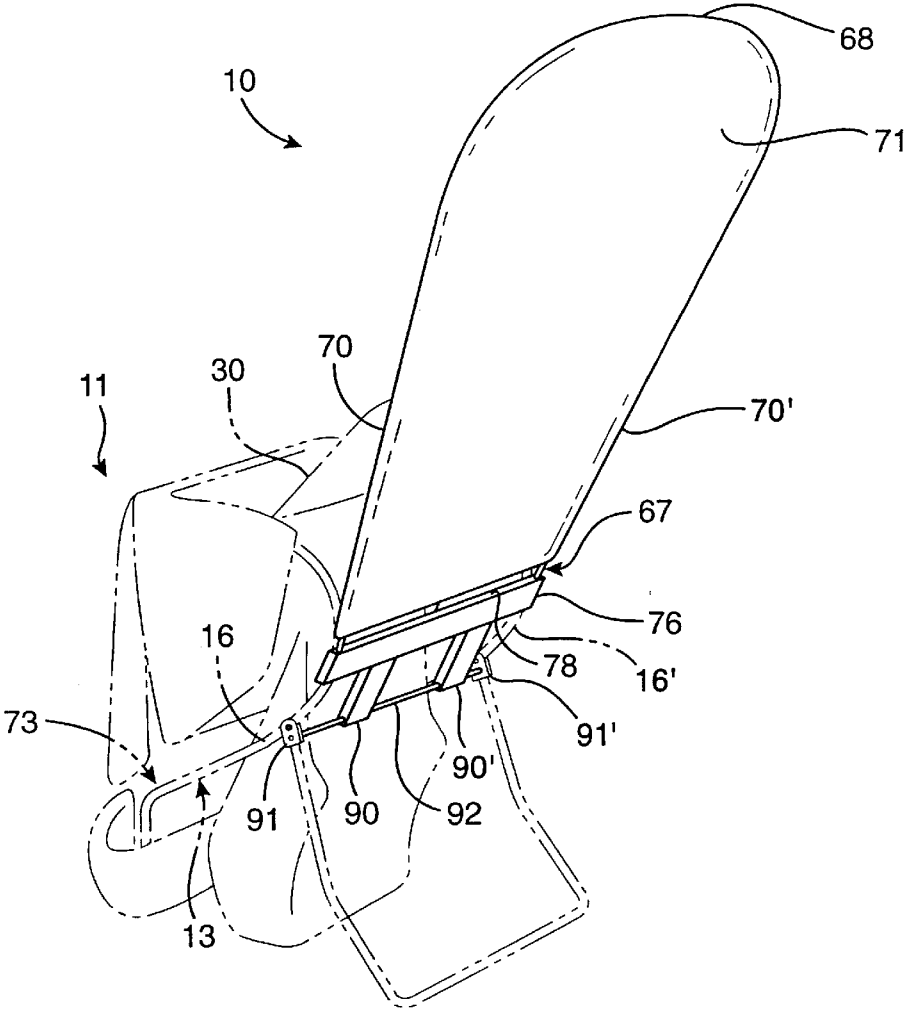
FIG. 10 is a rear perspective view of an alternative embodiment baby backpack sunshade device constructed in accordance with the present invention, shown mounted to a baby backpack apparatus and in an uncovered position.

In yet another alternative embodiment, as shown in FIGS. 9A and 9B, scissors-type foldable joints 65 may be included mounted to and between the leg portions 28 of the front shade support 23 and the leg portions 27 of the rear shade support 21. When the front shade support 23 is moved to the opened position, the scissors-type joint 65 is formed and dimensioned to be fully extended (FIG. 9A). In contrast, when the front shade support 23 is moved to the closed position, the scissors-type joint 65 would be folded together (FIG. 9B).

In the opened position, the scissors-type joint is slightly over extended until a nub member 66 of one of the arms engages an edge of other arm. Such over extension facilitates prevention of inadvertent closure, especially during windy conditions.

Referring now to FIGS. 10–14, another embodiment of the present invention sunshade device 10 is provided including a substantially flexible, resilient rod, generally designated 67, having an upper bight portion 68 and a pair of spaced-apart leg portions 70, 70'. The bight portion 68 is adapted for extending upwardly from the backpack 11, and the leg portions 70, 70' are adapted for extending downwardly from opposite sides of the bight portion 68. The first leg portion 70 is coupled to the baby backpack 11 proximate one side of the seat support 30, and an opposite second leg portion 70' of the rod 67 is coupled to the baby backpack 11 proximate an opposite second side of the seat support 30. The bight portion 68 and the leg portions 70, 70' cooperate to bias the resilient rod 67 toward an uncovered position (FIGS. 10, 12 (in phantom lines) and 13 ) which is not intended to provide protective shade to the seated occupant 12. The sunshade device 10 further includes a flexible, sheet-like sunshade 71 coupled to the resilient rod 67 which spans the bight portion 68 and the leg portions 70, 70'. A retaining device, generally designated 72, is provided which is adapted to couple the bight portion 68 to a forward portion 73 of the backpack 11 in a manner tautly retaining the resilient bight portion 68 and the sheet-like sunshade 71 in a covered position (FIGS. 11, 12 (in solid lines) and 14). In this position, the sunshade 71 extends over the seat support 30 for protective shading to the baby occupant 12 from the sun or rain.

Accordingly, when the resilient rod is positioned in the uncovered position (FIG. 10, phantom lines in FIG. 12 and FIG. 13), the sheet-like sunshade 71 is preferably positioned behind or rearwardly of the seated baby 12. This orientation provides ample room for ingress and egress to and from the baby seat support 30. In contrast, as viewed in the solid lines of FIG. 12 and in FIGS. 11 and 14, the flexible, resilient rod 67 and sheet-like sunshade 71 are adapted to resiliently move to a bowed orientation such that the bight portion 68 of the rod extends forwardly of the seated baby occupant 12 when the resilient rod 67 is in the covered position. The retaining device 72, subsequently, can be manually engaged to retain the resilient rod in the covered position, and to releasably prevent movement thereof back to the uncovered position. In this orientation, the forward positioning of the resilient rod, relative the backpack frame 13, assures that the sheet-like sunshade 71 extends sufficiently forward of the seated baby occupant to provide ample coverage or sun shielding forwardly thereof. Accordingly, in the covered position, the bowed resilient rod 67 and the sheet-like sunshade 71 cooperate to provide substantial sun shielding during outdoor use.

Figure 13:
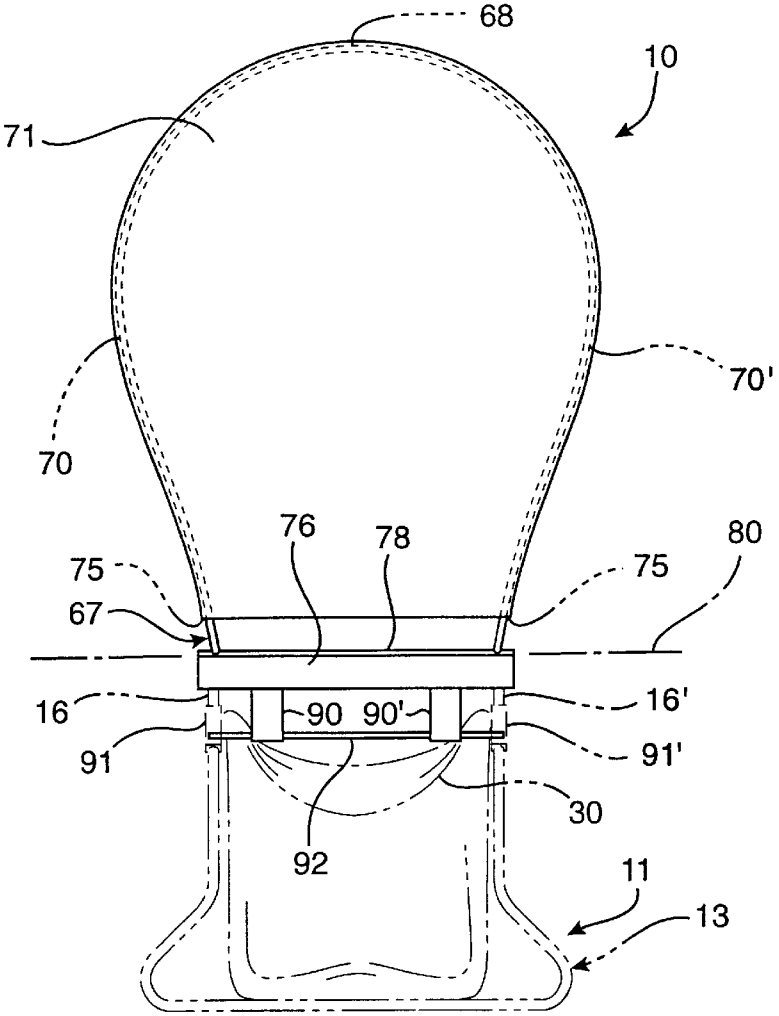
FIG. 13 is a rear elevation view of the baby backpack sunshade device of FIG. 10 in the uncovered position.

FIG. 13 best illustrates that the flexible, resilient rod 67 is preferably U-shaped or horseshoe shaped when mounted to the sunshade device 10. Again, it will be appreciated that the term "U-shaped" includes any shaped support having a cross-bar and two downwardly depending leg portions therefrom. Hence, the bight portion could be arcuate, smoothly integrated with the leg portions, or substantially straight, intersecting the leg portions perpendicularly or at generally right angles.

Rod 67 is substantially resilient and flexible so that the sheet-like sunshade 71 can be retained in a taut opened position while the rod is oriented in or moved between the covered position or the uncovered position. Preferably, the sheet-like sunshade 71 provides a U-shaped sleeve portion 75 which extends about a periphery of the sunshade. Hence, the resilient rod must be sufficiently flexible to adapt and conform to the curvature of the U-shaped sleeve portion 75 during insertion therethrough, yet be sufficiently resilient to retain the sunshade in a taut opened position during operational usage. In the preferred embodiment, the flexible, resilient rod 67 is provided by a straight fiberglass rod or the like having a diameter of about ⅛ inch to about ½ inch, and more preferably about 3⁄16 inch.

Figure 15:
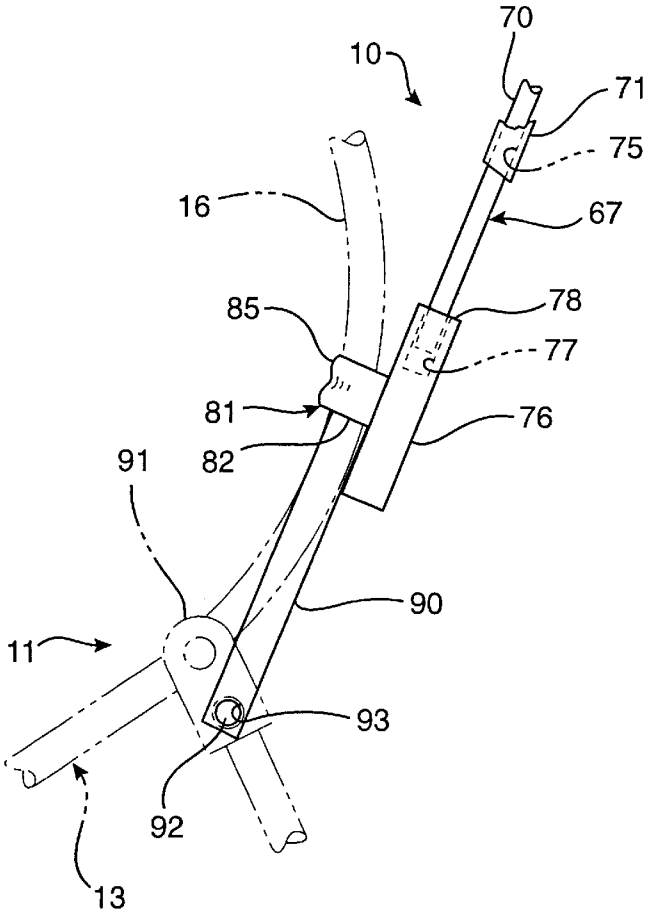
FIG. 15 is an enlarged, fragmentary, side elevation view of a mounting bracket of the baby backpack sunshade device of FIG. 12.
Figure 16:
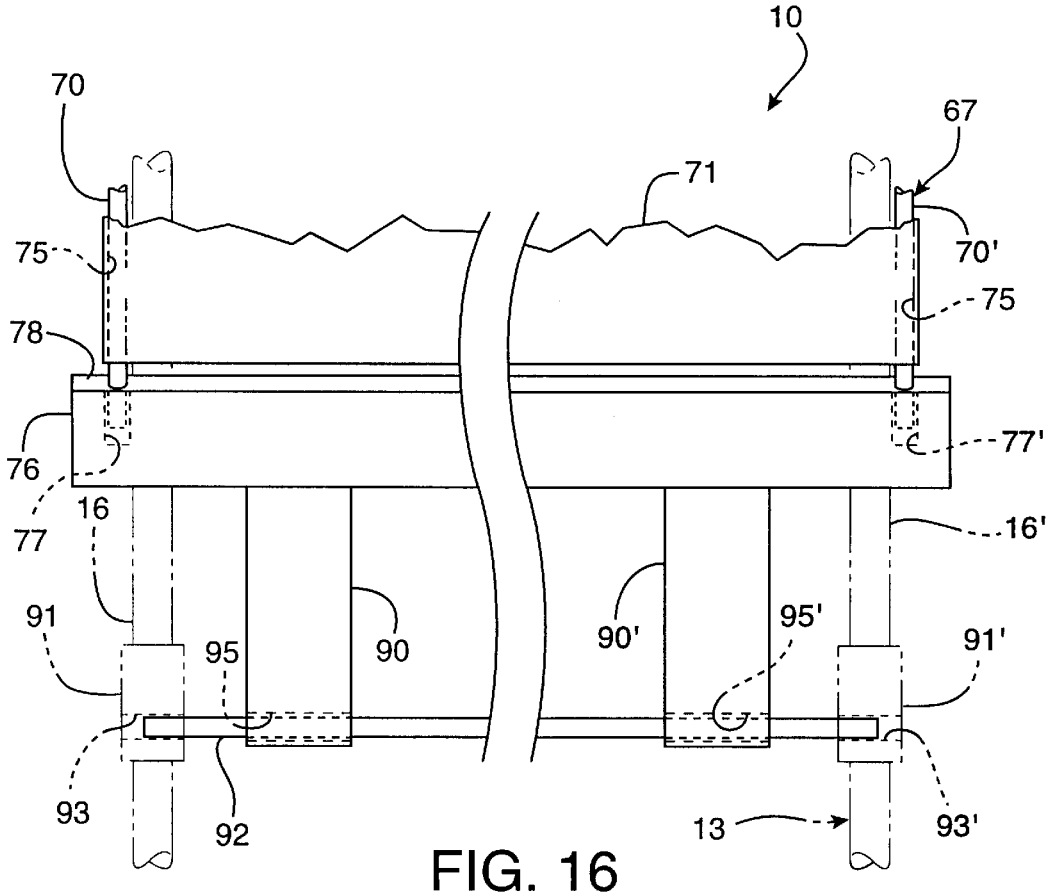
FIG. 16 is a fragmentary, rear elevation view of the mounting bracket of FIG. 15.
Figure 17:
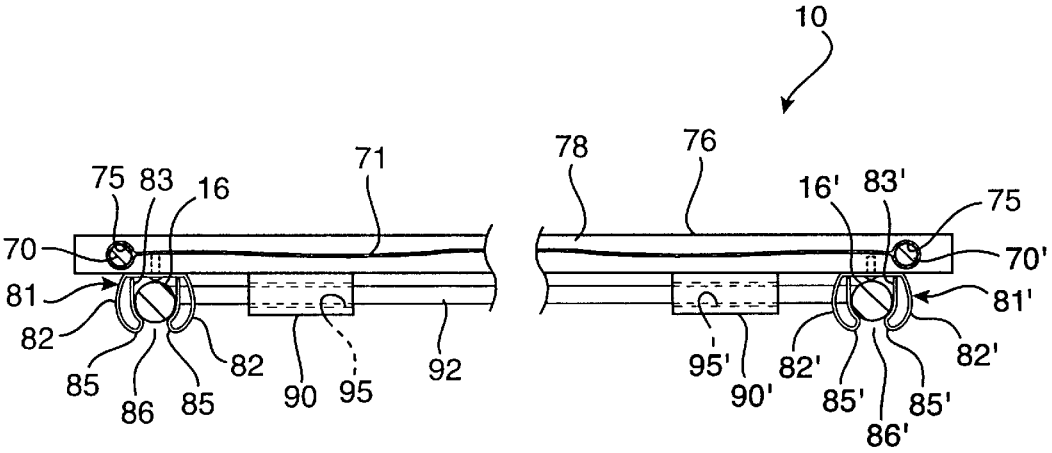
FIG. 17 is a fragmentary, top plan view of the mounting bracket of FIG. 15.

The distal ends of the first leg portion 70 and the second leg portion 70' are mounted to a stabilizing bar 76 extending transversely between the first frame portion 16 of the backpack 11 to the second frame portion 16' of the backpack. As illustrated in FIGS. 15–17, the distal ends of the rod leg portions 70, 70' are releasably and slidably received in respective mounting bores 77, 77' formed in the top surface 78 of stabilizing bar 76. This stabilizing bar 76 is in turn releasably, though rigidly, mounted to a rear location of the frame portions 16, 16'(FIG. 17).

By manually applying a forward force to resilient rod 67 in a manner urging the bight portion toward the covered position, the resilient rod bows about a first longitudinal axis 80 extending through the ends of the first and second leg portions 70, 70' mounted to the stabilizing bar. Accordingly, the resilient nature of the resilient rod 67 generates a first moment about the first longitudinal axis 80 which biases the tensioned resilient rod back toward the uncovered position. This bowed configuration is beneficial in that the seated occupant 12 is further provided with a greater amount of headroom during operational usage in the covered position. Incidentally, upon tensioned mounting of the flexible, resilient rod 67 in the mounting bores 77, 77' of the stabilizing bar 76, the resiliency of the rod generates a second moment about a second axis oriented substantially perpendicular to first axis 80 to bias said bight portion in the taut opened position.

In the preferred embodiment, a first mounting bracket 81 releasably couples one side of stabilizing bar 76 to the first frame portion 16 of the baby backpack, while a second mounting bracket 81' releasable couples the opposed side of the stabilizing bar to the opposite second frame portion 16' thereof. These mounting brackets 81, 81' are preferably provided by spring actuated mounting brackets adapted to releasably press-fit onto the respective frame portion. As best illustrated in FIG. 17, each spring actuated mounting bracket 81, 81' includes opposed resilient spring finger portions 82, 82' which collectively define mounting grooves 83, 83' therebetween. The inwardly curved distal tips 85, 85' of the finger portions 82, 82' cooperate to form an opening 86, 86' configured for receipt of the respective first frame portion 16 and the second frame portion 16' therein. Once the respective frame portions 16, 16' are urged through openings 86, 86' and past the respective inwardly curved finger portions 82, 82', the inwardly curved distal tips 85, 85' releasably retain the frame portions in respective mounting grooves 83, 83'. It will be appreciated, however, that other mounting brackets may be employed, such as mounting bracket 18 in the embodiment of FIGS. 4 and 5.

Figure 12:
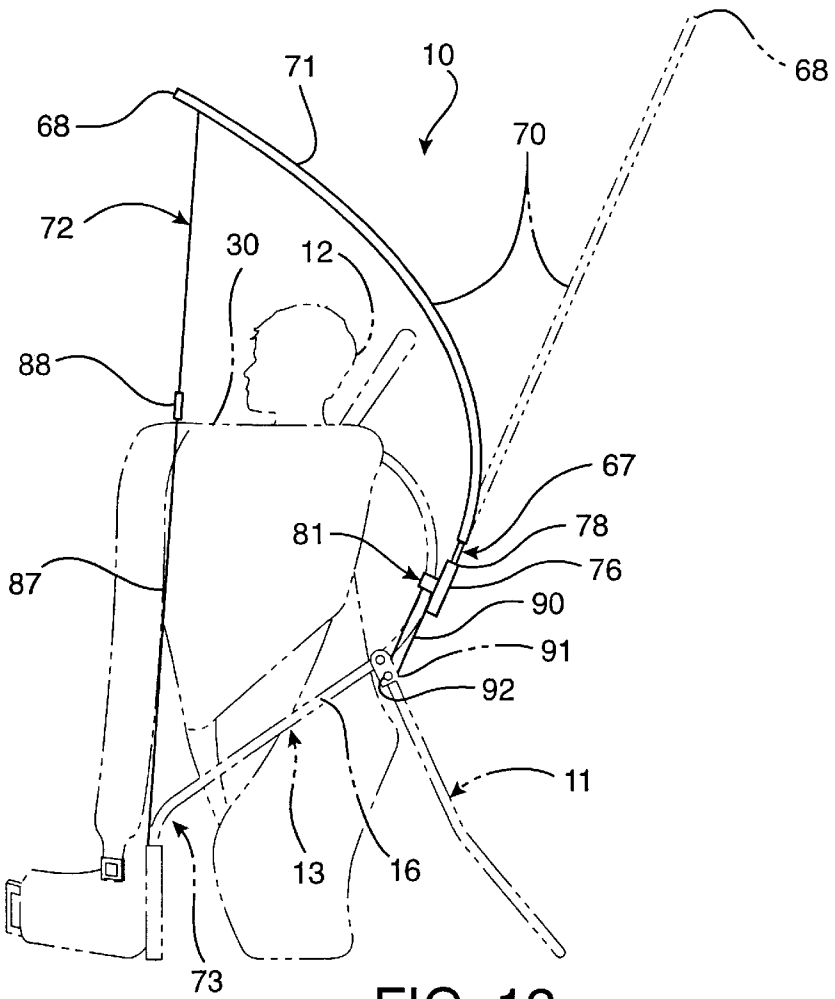
FIG. 12 is a side elevation view of the baby backpack sunshade device of FIG. 10, illustrating movement thereof between the covered position (shown in solid lines) and the uncovered position (shown in phantom lines).

The retaining device 72 is preferably provided by two spaced-apart strap members 87, 87' which cooperate to retain the resilient rod 67 in the covered position. As best viewed in FIGS. 12 and 14, the upper ends of the strap members 87, 87; are coupled to the bight portion 68 of the resilient rod while the respective lower portions thereof are coupled to a forward portion 73 of the backpack frame 13. This arrangement assures that the bight portion 68 and the sheet-like sunshade, in the covered position, are retained forwardly of the seated occupant to provide ample protective shade. FIG. 12 illustrates that the lower ends of the strap members 87, 87' are preferably coupled to the lower forward portions of the first and second frame portions 16, 16'. The ends of the strap members, however, may be mounted to the upper forward portions of the backpack frame as well.

Each strap member 87, 87' is preferably adjustable in length. This enables adjustment of the degree of forward bowing of the resilient rod 67 to provide a greater or lesser amount of protective shielding over the occupant. Moreover, conventional buckles 88, 88' are provided which releasably couple together. Upon detachment of the buckles 88, 88', the resiliency of the rod 67 urges the same from the covered position back to the uncovered position. Moreover, by only detaching one buckle, increased access for ingress and egress to and from the seat support is provided while the sunshade device 10 is still retained in the covered position.

Figure 14:
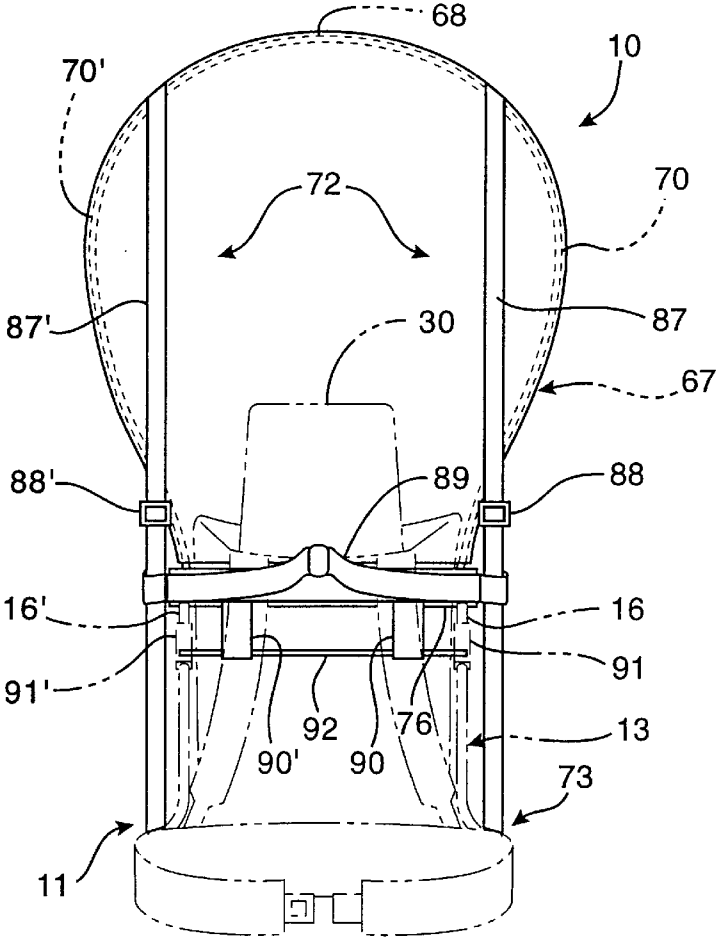
FIG. 14 is a front elevation view of the baby backpack sunshade device of FIG. 10 in the covered position.

As best viewed in FIG. 14, retaining device 72 includes a central strap 89 coupled to an upper portion of the backpack frame 13. Each end of the central strap 89 is coupled to a corresponding strap member 87, 87' which supports the same when the shade device is in the uncovered position. Hence, the central strap prevents the strap members from dangerously dangling down too far when they are not engaged with the resilient rod and the sunshade.

To further promote mounting support of the stabilizing bar 76 to the backpack frame 13, a lower support portion 90 is provided which is adapted to couple to the frame portions 16, 16' at a lower spaced-apart location than that of the mounting brackets 81, 81'. Two lower support portions 90, 90', as best viewed in FIGS. 15 and 16, extend downwardly from the stabilizing bar 76 which in turn are mounted to the opposed hinge members 91, 91' of the frame portions 16, 16'. A support bar 92 extends transversely across the hinge members 91, 91' which engages the lower support portions 90, 90' for secured coupling therebetween. A set of corresponding bores 93, 93', and 95, 95' extend into the hinge members 91, 91' and the lower support portions 90, 90', respectively, which are formed for sliding receipt of the support bar 92 therethrough upon axial alignment.

Subsequently, to mount the sunshade device 10 to the backpack frame 13, the stabilizing bar 76 may be rotated about the support bar longitudinal axis until the spring actuated mounting brackets 81, 81' engage the respective frame portions 16, 16' for releasable mounting thereto. In this configuration, hence, the lower support portions function as the primary mounting structure, while the spring actuated mounting brackets function to retain the shade upright against the backpack frame when not oriented in the covered position. On the other hand, to dismount the sunshade device 10 from the backpack frame 13, the spring actuated mounting brackets 81, 81' can be manually separated from securement to the respective frame portions 16, 16'. The stabilizing bar 76 may be pivotally moved about the longitudinal axis of the support bar 92 for storage or removal.

Hence, the sunshade device 10 can be mounted and dismounted to and from the backpack frame 13 easily and quickly to facilitate storage or transportability. It will appreciated that other types of securing devices may be employed to removably mount the respective mounting bracket to the respective frame portion. For example, the U-shaped bolt and mounting bracket described above in the previous embodiment may be employed. Moreover, this simple mounting arrangement enables retrofitting of the sunshade device to a plurality of baby backpacks frames, such as those above-mentioned.

Figure 18:
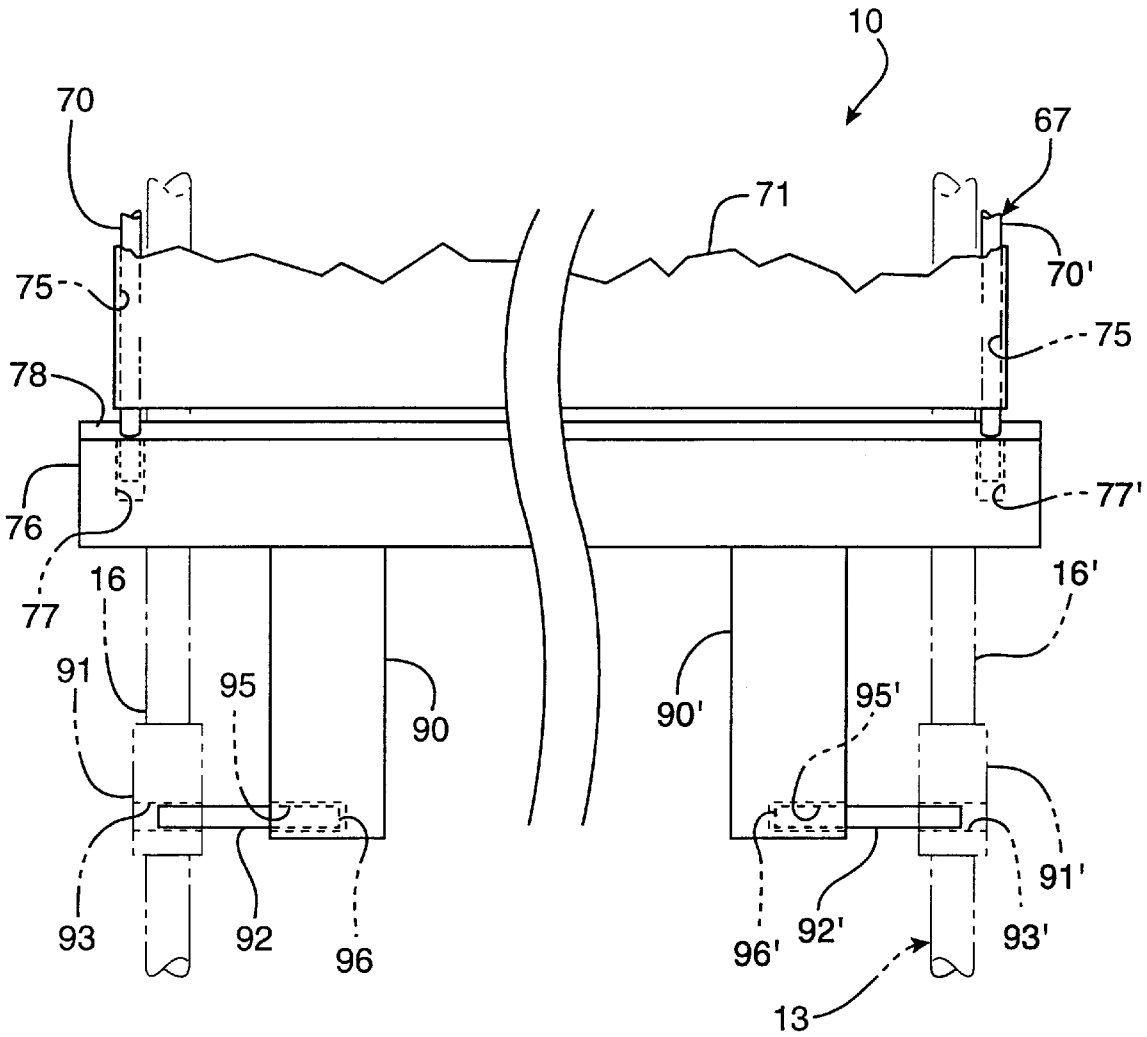
FIG. 18 is a fragmentary, rear elevation view of an alternative mounting bracket of FIG. 16.

Alternatively, as shown in FIG. 18, a pair of support bars 92, 92' may be provided, neither of which spans the distance from one hinge member 91 to the opposite hinge member 91'. In this arrangement, the mounting bores 95, 95' do not extend fully through the lower support portions 90, 90' so that the distal ends 96, 96' of the corresponding support bars 92, 92' abut against the ends of the corresponding mounting bores.

What is claimed is:

1. A sunshade device for use with a baby backpack formed for supporting an occupant in a seat support thereof, said sunshade device comprising:

a substantially flexible, resilient rod having an upper bight portion adapted for extending upwardly from said backpack, and first and opposite second leg portions extending downwardly from opposite sides of the bight portion, said first leg portion adapted to be coupled to the baby backpack proximate one side of the seat support, and said opposite second leg portion adapted to be coupled to the baby backpack proximate an opposite second side of the seat support, said bight portion and the leg portions cooperating to bias the resilient rod toward an uncovered position;

a flexible, sheet-like sunshade coupled to said resilient rod and spanning said bight portion and the leg portions;

a retaining device adapted to couple said bight portion to a forward portion of said backpack in a manner tautly retaining the bight portion and said sheet-like sunshade in a covered position, extending over the seated occupant for shielding thereof;

a first mounting bracket configured for releasably coupling the first leg portion to a first frame portion of the baby backpack; and a second mounting bracket configured for releasably coupling the second leg portion to an opposite second frame portion of the baby backpack, wherein said first mounting bracket and said second mounting bracket are mounted to a stabilizing bar adapted to extend transversely from the first frame portion to the second frame portion and separate from the first and second frame portions.

2. The sunshade device according to claim 1 wherein, each said first mounting bracket and said second mounting bracket defines a mounting groove formed and dimensioned to receive the first frame portion and the second frame portion, respectively, therein.

3. The sunshade device according to claim 2 wherein, the first mounting bracket and the second mounting bracket each includes a securing device for removably mounting the respective mounting bracket to the respective frame portion.

4. The sunshade device according to claim 3 wherein, each securing device is formed and dimensioned to secure the respective frame portion in and against the respective mounting groove.

5. The sunshade device according to claim 1 wherein, a lower support portion of said stabilizing bar is adapted to be mounted to the first frame portion and to the second frame portion at locations below the first mounting bracket and the second mounting bracket.

6. The sunshade device according to claim 5 wherein, said stabilizing bar includes a transversely extending rigid support post adapted to couple the support portion of the stabilizing bar to the first frame portion and the second frame portion.

7. The sunshade device according to claim 6 wherein, said support post is configured to pivotally mount said sunshade device to the first frame portion and the second frame portion.

* * * * *